US009461370B2

(12) United States Patent
Yona et al.

(10) Patent No.: US 9,461,370 B2
(45) Date of Patent: Oct. 4, 2016

(54) MULTIPLE-INPUT MULTIPLE-OUTPUT ANTENNA AND BROADBAND DIPOLE RADIATING ELEMENT THEREFORE

(71) Applicant: GALTRONICS CORPORATION LTD., Tiberias (IL)

(72) Inventors: Haim Yona, Givat Avni (IL); Shay Mamo, Tiberias (IL); Steve Krupa, Haifa (IL); Yaniv Ziv, Tiberias (IL)

(73) Assignee: GALTRONICS CORPORATION, LTD., Tiberias (IL)

( * ) Notice: Subject to any disclaimer, the term of this patent is extended or adjusted under 35 U.S.C. 154(b) by 75 days.

(21) Appl. No.: 14/386,243

(22) PCT Filed: Mar. 19, 2013

(86) PCT No.: PCT/IL2013/050266

§ 371 (c)(1),
(2) Date: Sep. 18, 2014

(87) PCT Pub. No.: WO2013/140408

PCT Pub. Date: Sep. 26, 2013

(65) Prior Publication Data

US 2015/0116174 A1 Apr. 30, 2015

Related U.S. Application Data

(60) Provisional application No. 61/612,442, filed on Mar. 19, 2012, provisional application No. 61/746,688, filed on Dec. 28, 2012.

(51) Int. Cl.

| | |
|---|---|
| ***H01Q 21/26*** | (2006.01) |
| ***H01Q 1/38*** | (2006.01) |
| ***H01Q 9/16*** | (2006.01) |
| ***H01Q 21/30*** | (2006.01) |
| ***H01Q 1/00*** | (2006.01) |
| ***H01Q 9/28*** | (2006.01) |

(52) U.S. Cl.

CPC ..... *H01Q 21/26* (2013.01); *H01Q 1/007* (2013.01); *H01Q 1/38* (2013.01); *H01Q 9/16* (2013.01); *H01Q 9/28* (2013.01); *H01Q 21/30* (2013.01)

(58) Field of Classification Search

CPC ..... H01Q 1/38; H01Q 21/26; H01Q 21/30; H01Q 9/16

USPC ..... 343/797, 798, 799

See application file for complete search history.

(56) References Cited

U.S. PATENT DOCUMENTS

| | | | |
|---|---|---|---|
| 4,814,777 | A | 3/1989 | Monser |
| 5,926,137 | A | 7/1999 | Nealy |

(Continued)

FOREIGN PATENT DOCUMENTS

| | | | |
|---|---|---|---|
| CN | 101548434 | A | 9/2009 |
| CN | 201797035 | U | 4/2011 |

(Continued)

OTHER PUBLICATIONS

U.S. Appl. No. 61/612,442, filed Mar. 19, 2012.

(Continued)

*Primary Examiner* — Hoanganh Le

(74) *Attorney, Agent, or Firm* — Lorenz & Kopf, LLP.

(57) ABSTRACT

An antenna, including a ground plane, a dielectric substrate formed on the ground plane, a broadband dual-polarized dipole radiating element located on the dielectric substrate, a horizontally polarized dipole radiating element located on the dielectric substrate adjacent to the broadband dual-polarized dipole radiating element and having a projection parallel to a first axis, which first axis intersects the broadband dual-polarized dipole radiating element, a vertically polarized dipole radiating element located on the dielectric substrate adjacent to the broadband dual-polarized dipole radiating element and having a projection parallel to a second axis, which second axis intersects the broadband dual-polarized dipole radiating element and is orthogonal to the first axis and a feed network for feeding the broadband dual-polarized, vertically and horizontally polarized dipole radiating elements.

20 Claims, 10 Drawing Sheets

(56) References Cited

U.S. PATENT DOCUMENTS

| | | | | |
|---|---|---|---|---|
| 6,977,616 | B2 | 12/2005 | Yuanzhu | |
| 7,064,725 | B2 | 6/2006 | Shtrikman et al. | |
| 7,075,498 | B2 | 7/2006 | Gottl et al. | |
| 8,395,561 | B2 * | 3/2013 | Park | H01Q 9/26 343/700 MS |
| 8,866,688 | B2 * | 10/2014 | Liu | H01Q 19/10 343/700 MS |
| 2004/0178964 | A1 * | 9/2004 | Gottl | H01Q 1/246 343/797 |
| 2005/0264463 | A1 | 12/2005 | Gottl et al. | |
| 2007/0080883 | A1 | 4/2007 | Boss et al. | |
| 2007/0210976 | A1 | 9/2007 | Luk et al. | |
| 2007/0229385 | A1 | 10/2007 | Deng et al. | |
| 2007/0241983 | A1 | 10/2007 | Cao et al. | |

FOREIGN PATENT DOCUMENTS

| | | | |
|---|---|---|---|
| CN | 201820883 | U | 5/2011 |
| CN | 203166098 | U | 8/2013 |
| DE | 19823749 | A1 | 12/1999 |
| EP | 2346114 | A2 | 7/2011 |
| GB | 2333400 | A | 7/1999 |
| WO | 01/67545 | | 9/2001 |
| WO | 2011/154954 | | 12/2011 |
| WO | 2013/140408 | | 9/2013 |

OTHER PUBLICATIONS

An International Preliminary Report on Patentability dated Sep. 23, 2014, which issued during the prosecution of Applicant's PCT/IL2013/050266.

An International Search Report and Written Opinion both dated Aug. 9, 2013, which issued during the prosecution of Applicant's PCT/IL2013/050266.

U.S. Appl. No. 61/746,688, filed Dec. 28, 2012.

European Patent Office, Extended European Search Report for Application No. EP 13764067.8-1812 mailed Oct. 27, 2015.

State Intellectual Property Office of the People's Republic of China, Office Action in Chinese Patent Application No. 201380021337.4 mailed Nov. 18, 2015.

* cited by examiner

MULTIPLE-INPUT MULTIPLE-OUTPUT ANTENNA AND BROADBAND DIPOLE RADIATING ELEMENT THEREFORE

REFERENCE TO RELATED APPLICATIONS

Reference is hereby made to U.S. Provisional Patent Application 61/612,442, entitled WIDEBAND UNIDIRECTIONAL ANTENNA WITH DUAL LINEAR SLANT±45° POLARIZATION AND EXCELLENT ELECTRICAL CHARACTERISTICS, filed Mar. 19, 2012, and to U.S. Provisional Patent Application 61/746,688, entitled BROADBAND, DUAL PORT, DUAL POLARIZED INDOOR AND/OR OUTDOOR WALL MOUNT ANTENNA, filed Dec. 28, 2012, the disclosures of which are hereby incorporated by reference and priorities of which are hereby claimed pursuant to 37 CFR 1.78(a)(4) and (5)(i).

FIELD OF THE INVENTION

The present invention relates generally to antennas and more particularly to multiple-input multiple-output (MIMO) antennas.

BACKGROUND OF THE INVENTION

The following Patent documents are believed to represent the current state of the art:

U.S. Pat. Nos. 7,259,728; 7,202,829 and 6,229,495.

SUMMARY OF THE INVENTION

The present invention seeks to provide a dual-polarized dual-band MIMO antenna and a broadband dipole radiating element particularly suitable for inclusion therein.

There is thus provided in accordance with a preferred embodiment of the present invention an antenna, including a ground plane, a dielectric substrate formed on the ground plane, a broadband dual-polarized dipole radiating element located on the dielectric substrate, a horizontally polarized dipole radiating element located on the dielectric substrate adjacent to the broadband dual-polarized dipole radiating element and having a projection parallel to a first axis, which first axis intersects the broadband dual-polarized dipole radiating element, a vertically polarized dipole radiating element located on the dielectric substrate adjacent to the broadband dual-polarized dipole radiating element and having a projection parallel to a second axis, which second axis intersects the broadband dual-polarized dipole radiating element and is orthogonal to the first axis and a feed network for feeding the broadband dual-polarized, vertically and horizontally polarized dipole radiating elements.

In accordance with a preferred embodiment of the present invention, the broadband dual-polarized dipole radiating element includes a quartet of radiating patches operative as a first pair of dipoles at a first polarization and as a second pair of dipoles at a second polarization, each dipole of the first and second pairs of dipoles including two radiating patches of the quartet of radiating patches and a feed arrangement for feeding the first and second pairs of dipoles, the feed arrangement including a feedline galvanically connected to one of the two radiating patches including each dipole and a balun galvanically connected to another one of the two radiating patches including each dipole.

Preferably, the broadband dual-polarized dipole radiating element is polarized at ±45°.

Preferably, the horizontally polarized dipole radiating element is located parallel to the first axis and the vertically polarized dipole radiating element is located parallel to the second axis.

In accordance with another preferred embodiment of the present invention, the broadband dual-polarized dipole radiating element is operative to radiate in a high frequency band.

Preferably, the horizontally polarized and vertically polarized dipole radiating elements are operative to radiate in a low frequency band.

Preferably, the high frequency band includes frequencies between 1700 and 2700 MHz.

Preferably, the low frequency band includes frequencies between 690 and 960 MHz.

In accordance with a further preferred embodiment of the present invention, the dielectric substrate is galvanically connected to the ground plane.

Preferably, the dielectric substrate includes a printed circuit board substrate.

Preferably, the feed network is formed on an underside of the printed circuit board substrate.

Preferably, the ground plane includes a tray having a plurality of prolongation strips extending therefrom.

In accordance with yet another preferred embodiment of the present invention, the feed network receives input signals at a first port and a second port.

Preferably, the first and second ports are connected to coaxial cables.

Preferably, the feed network includes at least a first diplexer and a second diplexer.

Preferably, the quartet of radiating patches is supported by a dipole stem, the dipole stem having an X-shaped configuration including a first, a second, a third and a fourth rib.

Preferably, the feed arrangement includes a first microstrip feedline formed on a first side of the first rib and a first balun formed on a second opposite side of the first rib, a second microstrip feedline formed on a first side of the second rib and a second balun formed on a second opposite side of the second rib, a third microstrip feedline formed on a first side of the third rib and a third balun formed on a second opposite side of the third rib and a fourth microstrip feedline formed on a first side of the fourth rib and a fourth balun formed on a second opposite side of the fourth rib.

There is further provided in accordance with another preferred embodiment of the present invention a broadband dual-polarized dipole radiating element including a quartet of radiating patches operative as a first pair of dipoles at a first polarization and as a second pair of dipoles at a second polarization, each dipole of the first and second pairs of dipoles including two radiating patches of the quartet of radiating patches and a feed arrangement for feeding the first and second pairs of dipoles, the feed arrangement including a feedline galvanically connected to one of the two radiating patches including each dipole and a balun galvanically connected to another one of the two radiating patches including each dipole.

Preferably, the first and second polarizations include polarizations of ±45°.

Preferably, the first and second pairs of dipoles are operative to radiate in a high frequency band of 1700-2700 MHz.

Preferably, the quartet of radiating patches is supported by a dipole stem, the dipole stem having an X-shaped configuration including a first, a second, a third and a fourth rib.

Preferably, the feed arrangement includes a first microstrip feedline formed on a first side of the first rib and a first balun formed on a second opposite side of the first rib, a second microstrip feedline formed on a first side of the second rib and a second balun formed on a second opposite side of the second rib, a third microstrip feedline formed on a first side of the third rib and a third balun formed on a second opposite side of the third rib and a fourth microstrip feedline formed on a first side of the fourth rib and a fourth balun formed on a second opposite side of the fourth rib.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
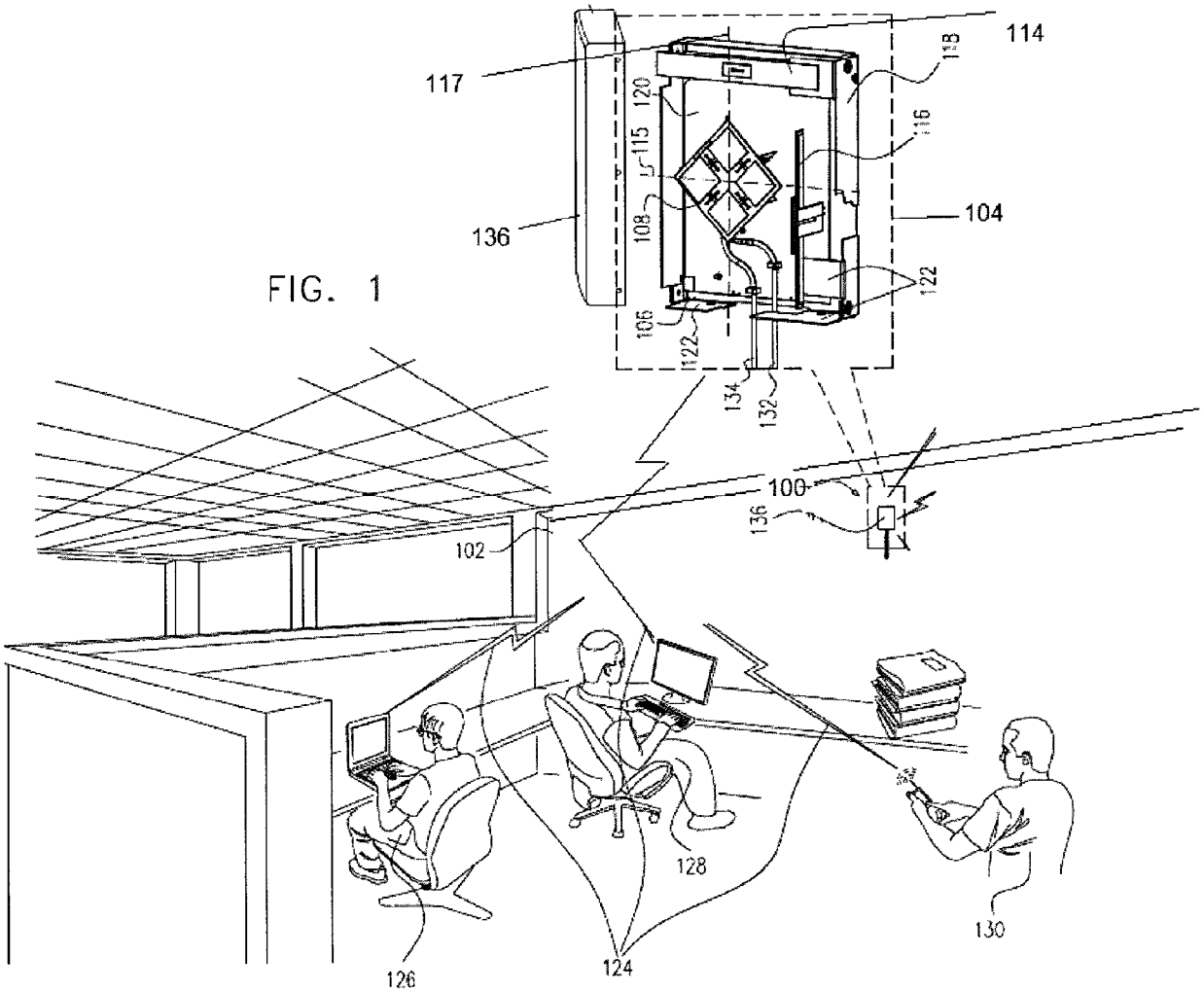
FIG. 1 is a schematic illustration of an antenna constructed and operative in accordance with a preferred embodiment of the present invention.

Reference is now made to FIG. 1, which is a schematic illustration of an antenna constructed and operative in accordance with a preferred embodiment of the present invention.

As seen in FIG. 1, there is provided an antenna 100. Antenna 100 is preferably an indoor-type antenna and is particularly preferably adapted for mounting on a wall 102. However, it is appreciated that antenna 100 may alternatively be adapted for mounting on a variety of indoor and/or outdoor surfaces, depending on the operating requirements of antenna 100.

As best seen at enlargement 104, antenna 100 includes a ground plane 106. A broadband dipole radiating element 108 is preferably located on ground plane 106. Broadband dipole radiating element 108 is preferably operative to transmit a dual-polarized signal having slanted ±45° polarizations. Broadband dipole radiating element 108 may hence be termed a broadband dual-polarized dipole radiating element 108.

A horizontally polarized dipole radiating element 114 is preferably located on ground plane 106 adjacent to dual-polarized dipole radiating element 108 and having a projection parallel to a first axis 115, which first axis 115 preferably intersects broadband dual-polarized dipole radiating element 108. A vertically polarized dipole radiating element 116 is preferably located on ground plane 106 adjacent to dual-polarized dipole radiating element 108 and having a projection parallel to a second axis 117, which second axis 117 preferably intersects broadband dual-polarized dipole radiating element 108 and is orthogonal to first axis 115. Here, by way of example, horizontally and vertically polarized dipole radiating elements 114 and 116 are seen to be respectively located parallel to first and second axes 115 and 117.

In operation of antenna 100, dual-polarized dipole radiating element 108 preferably radiates in a high frequency band of 1700-2700 MHz and horizontally and vertically polarized dipole radiating elements 114 and 116 preferably radiate in a low frequency band of 690-960 MHz. It is appreciated that antenna 100 thus constitutes a dual-band dual-polarized antenna, capable of simultaneously radiating high frequency slanted ±45° radio-frequency (RF) signals and low frequency vertically and horizontally polarized RF signals, by way of the simultaneous respective operation of the ±45° dual-polarized, horizontally and vertically polarized dipole radiating elements 108, 114 and 116. Due to their mutually orthogonal polarizations, horizontally and vertically polarized dipole radiating elements 114 and 116 are decorrelated, making antenna 100 particularly well suited for MIMO applications.

It is further appreciated that the configurations of horizontally and vertically polarized dipole radiating elements 114 and 116 are exemplary only and that a variety of other configurations and arrangements of horizontally and vertically polarized dipole radiating elements are also possible, provided that the horizontally and vertically polarized dipole radiating elements 114 and 116 are located so as to have respective projections parallel to the orthogonal axes 115 and 117 intersecting dual-polarized dipole radiating element 108.

In a preferred embodiment of antenna 100 illustrated in FIG. 1, ground plane 106 is seen to comprise a ground tray 118 having a dielectric substrate 120 preferably disposed thereon and galvanically connected thereto. Dielectric substrate 120 preferably is a printed circuit board (PCB) substrate, preferably adapted for the formation of a feed network (not shown) integrally therewith.

The structure and arrangement of ground tray 118 and dielectric substrate 120 are particular features of a preferred embodiment of the present invention and create several significant advantages in the operation of antenna 100.

The size, shape and location of ground tray 118 serve to control the radiation patterns and isolation of dual-polarized dipole radiating element 108 and horizontally and vertically polarized dipole radiating elements 114 and 116 in their respective high and low frequency bands of operation. In a particularly preferred embodiment of the present invention, ground tray 118 includes a multiplicity of prolongation strips 122 extending therefrom. Prolongation strips 122 contribute to the shaping of a uniform beam pattern of antenna 100 and improve isolation in the low frequency band of operation. Isolation in the low frequency band of operation is further improved as a result of the galvanic connection between dielectric substrate 120 and ground tray 118.

The above-described arrangement of ground tray 118 with respect to dual-polarized dipole radiating element 108 and horizontally and vertically polarized dipole radiating elements 114 and 116 leads to the formation of balanced, uniform, directional and diversely polarized radiation patterns by dual-polarized dipole radiating element 108 and horizontally and vertically polarized dipole radiating elements 114 and 116. Such radiation patterns make antenna 100 particularly well suited for deployment as a wall-mount type antenna, as indicated by pictorially represented RF beams 124.

Due to the balanced, uniform and well-isolated beam patterns of dual-polarized dipole radiating element 108 and horizontally and vertically polarized dipole radiating elements 114 and 116, antenna 100 may serve a multiplicity of users, such as users 126, 128 and 130, with high RF data throughput rates and minimal fading and scattering effects. Furthermore, since dual-polarized dipole radiating element 108 and horizontally and vertically polarized dipole radiating elements 114 and 116 are mounted in close proximity to each other on a single platform formed by ground tray 118, antenna 100 is extremely compact and relatively simple and inexpensive to manufacture in comparison to conventional MIMO antennas.

Dual-polarized dipole radiating element 108 and horizontally polarized dipole radiating element 114 preferably receive an RF input signal having a first polarization at a first port connected to a first coaxial cable 132 and dual-polarized dipole radiating element 108 and vertically polarized dipole radiating element 116 preferably receive an RF input signal having a second polarization at a second port connected to a second coaxial cable 134. Further details of the feed arrangement via which dual-polarized dipole radiating element 108 and horizontally and vertically polarized dipole radiating elements 114 and 116 are preferably fed are set forth below with references to FIGS. 2A-3.

Antenna 100 may optionally be housed by a cover 136, which cover 136 preferably has both aesthetic and protective functions. Cover 136 may be formed of any suitable material that does not distort the preferred radiation patterns of antenna 100.

Figure 2A:
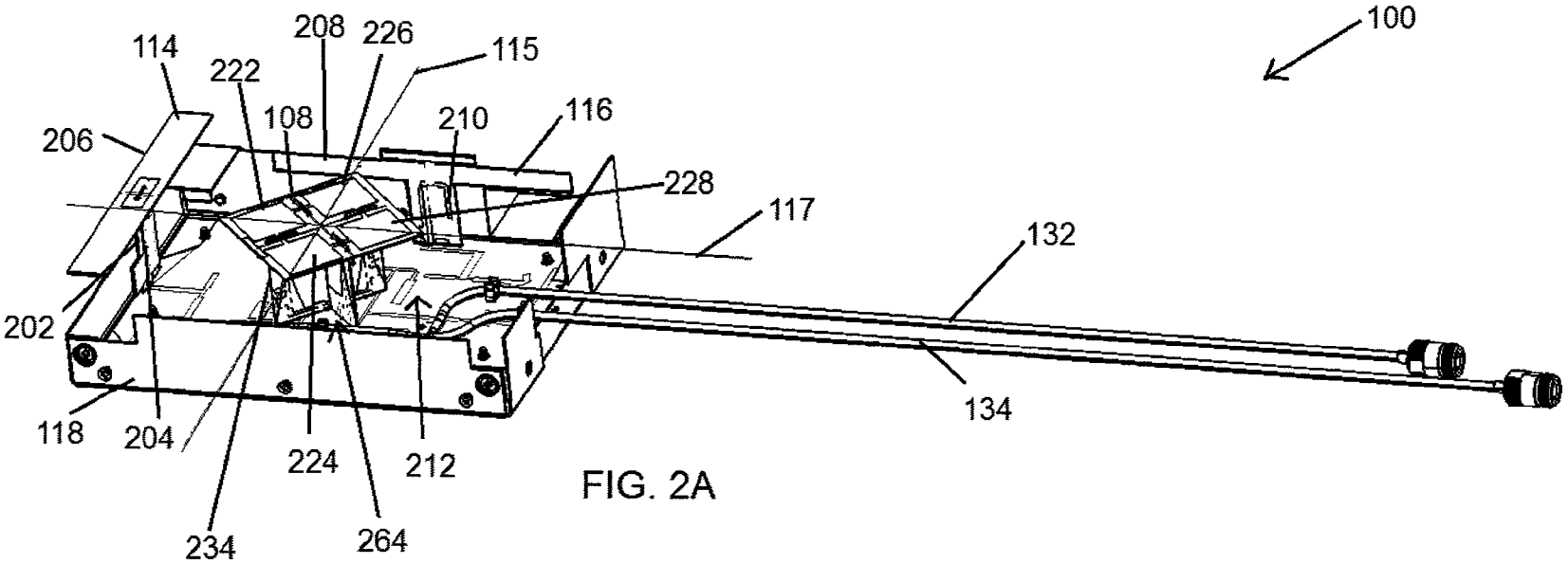
FIGS. 2A, 2B and 2C are simplified respective first and second perspective views and top view illustrations of an antenna of the type illustrated in FIG. 1.
Figure 2B:
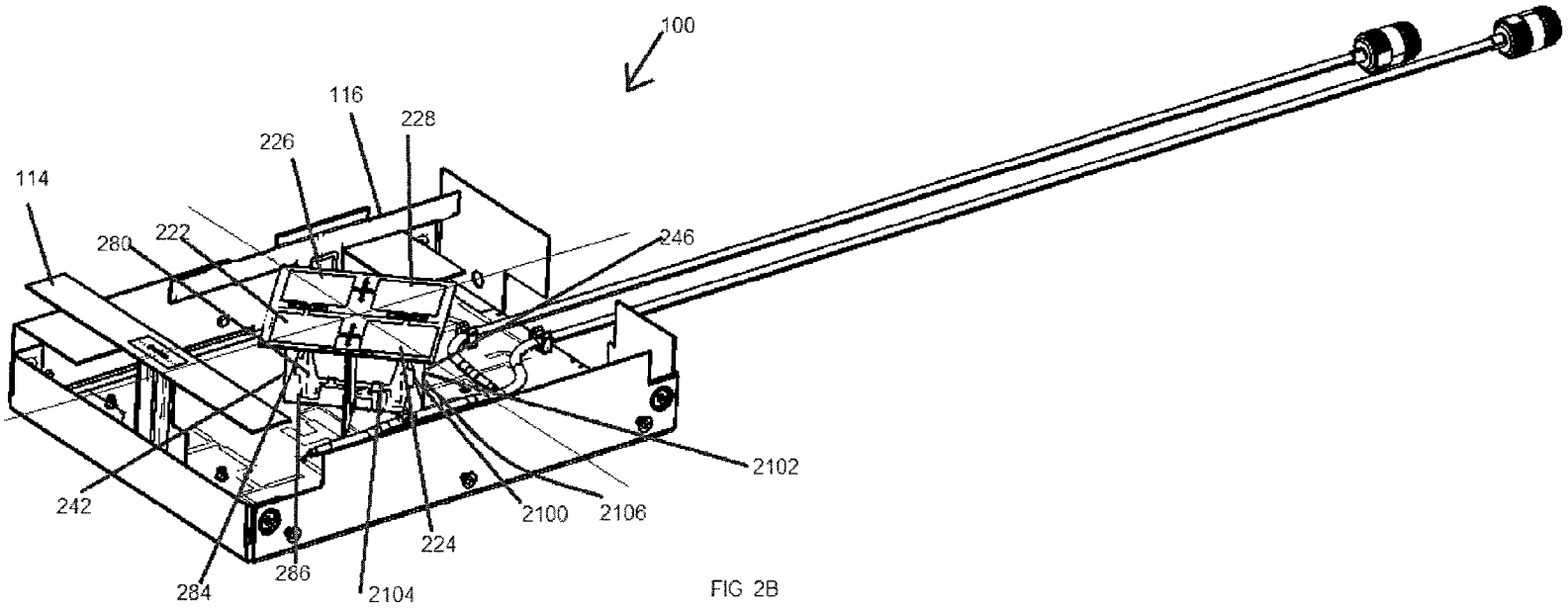
Figure 2C:
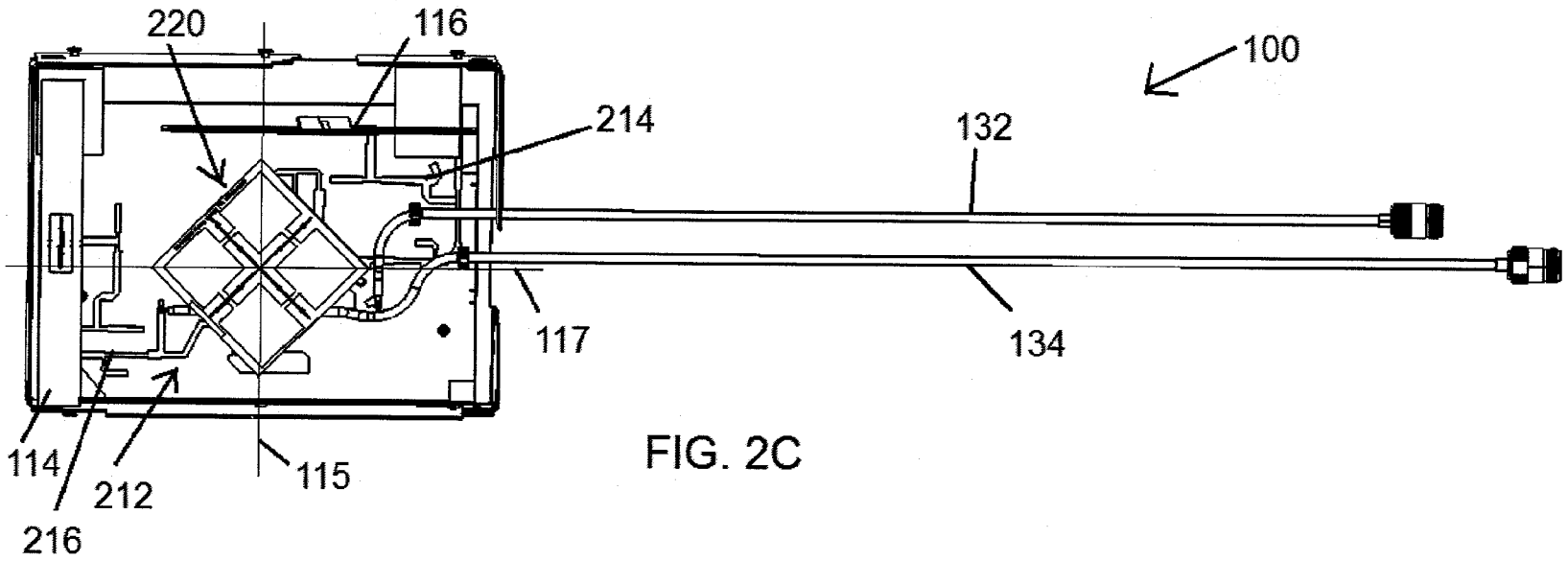
Figure 3:
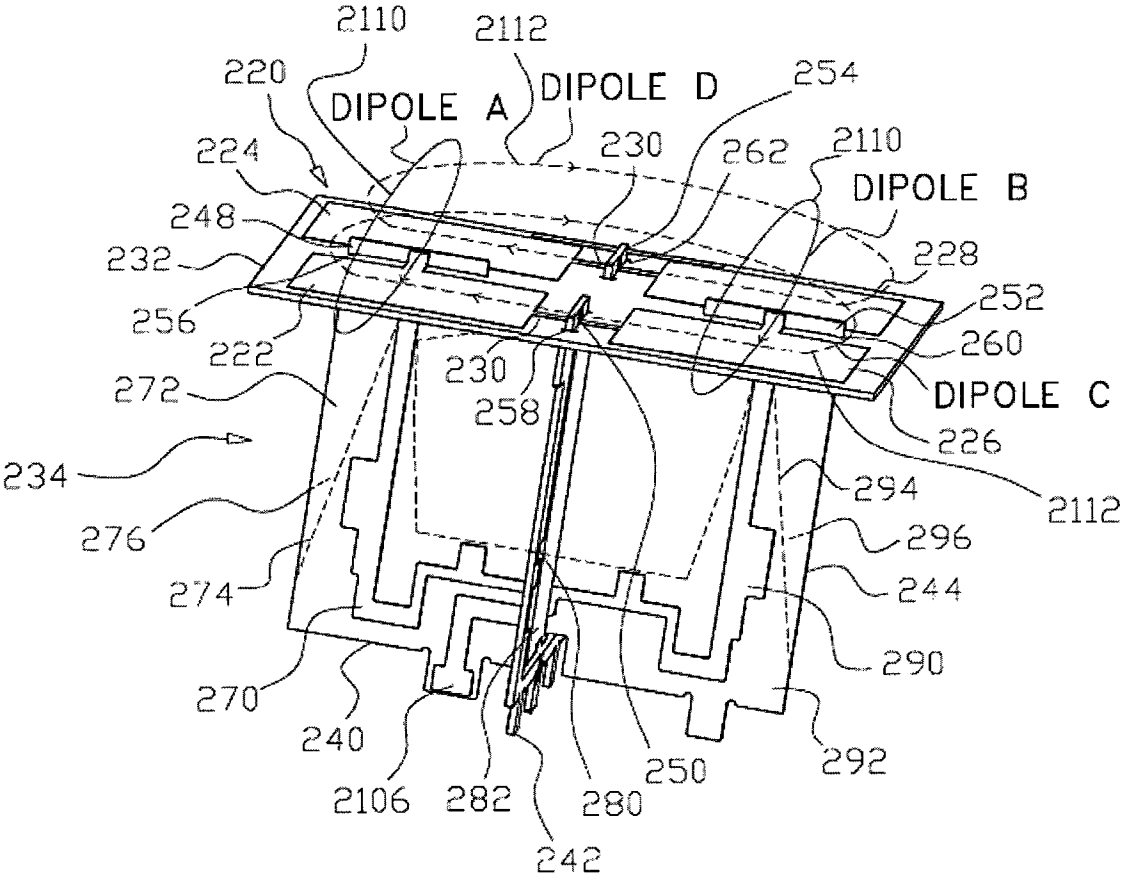
FIG. 3 is a simplified expanded view of a radiating element useful in an antenna of the type illustrated in FIGS. 1-2C.

Reference is now made to FIGS. 2A, 2B and 2C, which are simplified respective first and second perspective views and top view illustrations of an antenna of the type illustrated in FIG. 1; and to FIG. 3, which is a simplified expanded view of a radiating element useful in an antenna of the type illustrated in FIGS. 1-2C.

As seen in FIGS. 2A-3, antenna 100 includes broadband dual-polarized dipole radiating element 108, horizontally polarized dipole radiating element 114 and vertically polarized dipole radiating element 116. Broadband dual-polarized dipole radiating element 108, horizontally polarized dipole radiating element 114 and vertically polarized dipole radiating element 116 are preferably located on ground tray 118 and fed by first and second coaxial cables 132 and 134.

As seen most clearly in FIGS. 2A and 2B, horizontally polarized dipole radiating element 114 and vertically polarized dipole radiating element 116 preferably comprise different types of dipoles having different feed arrangements, in order to minimize interference therebetween. Thus, horizontally polarized dipole radiating element 114 preferably comprises a dipole stem 202 having a microstrip feedline 204 integrated therewith and a dipole arm section 206. Vertically polarized dipole radiating element 116 is preferably embodied as a monolithic element 208 including a microstrip feedline 210 formed thereon.

Microstrip feedlines 204 and 210 are preferably connected to and fed by a feed network 212. As seen most clearly in FIG. 2C, feed network 212 preferably comprises a first diplexer 214 and a second diplexer 216. First and second diplexers 214 and 216 are preferably operative to divide the signal delivered by first and second coaxial cables 132 and 134, thereby allowing dual-polarized dipole radiating element 108 and horizontally and vertically polarized dipole radiating elements 114 and 116 to be fed by only two ports, thus simplifying the feed arrangement of antenna 100. Feed network 212 is preferably formed on an underside of dielectric substrate 120. It is appreciated that feed network 212 is shown as visible in FIGS. 2A-2C only for the purpose of clarity of presentation.

As seen most clearly in FIG. 3, dual-polarized dipole radiating element 108 preferably comprises a quartet of radiating patches 220 offset from the ground plane 106. In the embodiment of dual-polarized dipole radiating element 108 illustrated in FIGS. 1A-3, quartet of radiating patches 220 is shown to comprise a first, a second, a third and a fourth square patch 222, 224, 226 and 228, which first-fourth patches 222-228 are preferably interconnected by a multiplicity of galvanic connection portions 230.

In operation of dual-polarized dipole radiating element 108, quartet of radiating patches 220 is preferably operative as a first pair of dipoles at a first polarization and as a second pair of dipoles at a second polarization, in a manner to be described henceforth.

Quartet of radiating patches 220 is preferably supported by a dielectric platform 232, which dielectric platform 232 is preferably disposed atop of a dipole stem 234. It is appreciated, however, that quartet of radiating patches 220 may alternatively be disposed above dipole stem 234 by other means known in the art, whereby dielectric platform 232 may be replaced by an alternative non-conductive structure or obviated.

Dipole stem 234 preferably has an X-shaped configuration preferably formed by four intersecting mutually perpendicular ribs 240, 242, 244 and 246, each one of which four ribs 240, 242, 244 and 246 preferably respectively includes an extruding upper stub portion 248, 250, 252, 254. As seen most clearly in FIG. 3, extruding upper stub portions 248, 250, 252, 254 preferably slot into four slots 256, 258, 260, 262 formed in dielectric platform 232 when radiating element 108 is in its assembled state.

It is understood that the above-described arrangement of dipole stem 234 with respect to dielectric platform 232 is exemplary only and that dipole stem 234 may alternatively be configured so as to support dielectric platform 232 by way of various other arrangements, as will be readily appreciated by one skilled in the art.

Quartet of radiating patches 220 is fed by a feed arrangement 264, which feed arrangement 264 is preferably integrated with dipole stem 234. It is a particular feature of a preferred embodiment of the present invention that feed arrangement 264 is preferably integrated with dipole stem 234 rather than being formed as an external, separate feed arrangement, thus simplifying the structure of radiating element 108 and minimizing its size.

Feed arrangement 264 particularly preferably includes a first microstrip feedline 270 formed on a first side 272 of rib 240 and a first balun 274 formed on a second opposite side 276 of rib 240; a second microstrip feedline 280 formed on a first side 282 of rib 242 and a second balun 284 formed on a second opposite side 286 of rib 242; a third microstrip feedline 290 formed on a first side 292 of rib 244 and a third balun 294 formed on a second opposite side 296 of rib 244; and a fourth microstrip feedline 2100 formed on a first side 2102 of rib 246 and a fourth balun 2104 formed on a second opposite side 2106 of rib 246.

As best appreciated in the case of ribs 240, 242 and 244 from consideration of FIG. 3, as a result of ribs 240, 242, 244 and 246 slotting into slots 256, 258, 260, 262 in dielectric platform 232, feedlines 270, 280, 290 and 2100, and baluns 274, 284, 294 and 2104 are preferably each in galvanic contact with multiplicity of galvanic connection portions 230, and hence in galvanic contact with radiating patches 222, 224, 226 and 228, when radiating element 108 is in its assembled state.

It is a particular feature of a preferred embodiment of the present invention that the feedlines 270, 280, 290 and 2100 are galvanically connected to the radiating patches 222, 224, 226 and 228, resulting in a robust, simple and easy to manufacture feeding arrangement of radiating element 108. However, were it not for the provision of baluns 274, 284, 294 and 2104, such a galvanic feeding arrangement would result in a limited bandwidth of radiating element 108. Thus, the provision of baluns 274, 284, 294 and 2104 serves to advantageously widen the bandwidth of radiating element 108.

It is appreciated that the particular configurations of feedlines 270, 280, 290 and 2100 and baluns 274, 284, 294 and 2104 shown in FIGS. 2A-3 are exemplary only and may be readily modified by one skilled in the art in accordance with the design and operating requirements of radiating element 108.

Feedlines 270 and 290 are preferably connected to a first 2:1 splitter 2106 and feedlines 280 and 2100 are preferably connected to a second 2:1 splitter (not shown).

In operation of radiating element 108, feedlines 270 and 280 preferably receive a ±45° polarized signal, preferably by way of coaxial cables 132 and 134 coupled to the 2:1 splitters. The current distribution of the ±45° polarized signal across radiating patches 222, 224, 226 and 228 is illustrated in FIG. 3. In FIG. 3, solid lines 2110 are used to indicate the current distribution for a first one of the dual ±45° polarized signals and dashed lines 2112 are used to indicate the current distribution for a second one of the dual ±45° polarized signals.

As seen most clearly in FIG. 3, at a first polarization indicated by solid lines 2110, radiating patch 222 and radiating patch 224 form one dipole, termed dipole A, and radiating patch 226 and radiating patch 228 form another dipole, termed dipole B, located parallel to dipole A. Similarly, at a second polarization indicated by dashed lines 2112, radiating patches 222 and 226 form one dipole, termed dipole C, and radiating patches 224 and 228 form another dipole, termed dipole D, located parallel to dipole C. Quartet of radiating patches 220 is thus operative as a first pair of dipoles, namely dipoles A and B, at a first polarization and as a second pair of dipoles, namely dipoles C and D, at a second polarization, each dipole of the first and second pairs of dipoles comprising two radiating patches of the quartet of radiating patches 220.

As is evident from consideration of FIGS. 2A-3, one of the two radiating patches comprising each dipole of the pair of dipoles formed at each polarization is operatively connected to one of microstrip feedlines 270, 280, 290 and 2100 and another one of the two radiating patches comprising each dipole of the pair of dipoles formed at each polarization is operatively connected to one of baluns 274, 284, 294 and 2104.

It is understood that the term 'operatively connected' is used here to distinguish between the operative feeding arrangement for each dipole of the pair of dipoles formed at each polarization and the passive galvanic connection of each radiating patch to multiple feedlines and baluns, only a portion of which multiple feedlines and baluns actively feed each radiating patch at each polarization.

It is a particular feature of a preferred embodiment of the present invention that the feed arrangement for feeding the first and second pairs of dipoles at each polarization includes a feedline, here embodied by way of example as a microstrip feedline, galvanically connected to one of the two radiating elements of each dipole and a balun galvanically connected to the other one of the two radiating elements of each dipole. As a result of this feed arrangement, only one radiating patch of each dipole of the first and second pairs of dipoles is connected to the ground plane by way of the balun. This is in contrast to conventional dual-polarized patch antennas in which both patches forming a single dipole are typically connected to the ground.

Thus, in the case of dipole A, radiating patch 222 is operatively connected to feedline 270 and radiating patch 224 is operatively connected to balun 274 and in the case of dipole B, radiating patch 226 is operatively connected to feedline 290 and radiating patch 228 is operatively connected to balun 294, as seen most clearly in FIG. 3. In the case of dipole C, radiating patch 226 is operatively connected to feedline 280 and radiating patch 222 is operatively connected to balun 284 and in the case of dipole D, radiating patch 228 is operatively connected to feedline 2100 and radiating patch 224 is operatively connected to balun 2104, as seen most clearly in FIG. 2B.

Figure 4E:
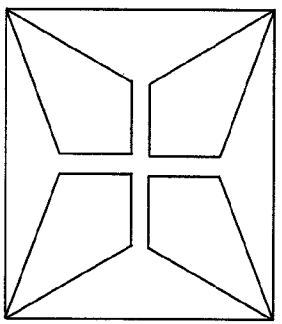
FIGS. 4A, 4B, 4C, 4D and 4E are simplified top view illustrations of five alternative embodiments of a radiating element of the type shown in FIG. 3.
Figure 4C:
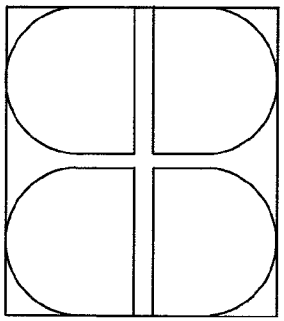
Figure 4D:
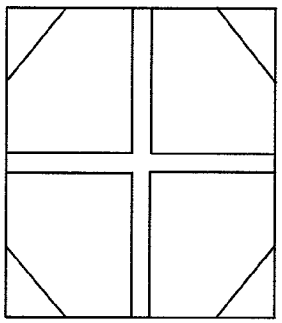
Figure 4A:
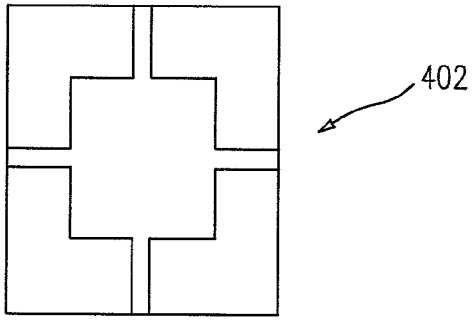
Figure 4B:
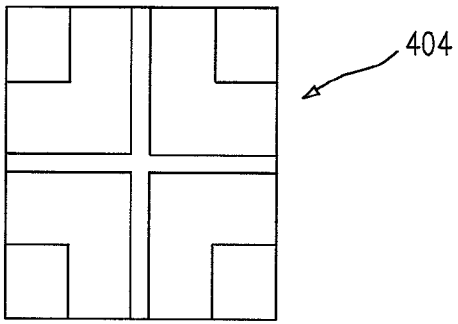

Each one of first-fourth square patches 222, 224, 226 and 228 preferably has a width of the order of $\lambda/4$, where $\lambda$ is an operating wavelength corresponding to a frequency of operation of radiating element 108. It is understood that the square shape of first-fourth square patches 222, 224, 226 and 228 shown in FIGS. 1A-3 is exemplary only and that each radiating patch of quartet of radiating patches 220 may alternatively comprise differently shaped radiating patches having a dimension of the order of $\lambda/4$. Alternative preferred embodiments of quartet of radiating patches 220 include a quartet of inverted L-shaped patches 402, shown in FIG. 4A, a quartet of L-shaped patches 404 shown in FIG. 4B, a quartet of semi-circular patches 406 shown in FIG. 4C, a quartet of truncated triangular patches 408 shown in FIG. 4D and a quartet of quadrilateral patches 410 shown in FIG. 4E.

Figure 5A:
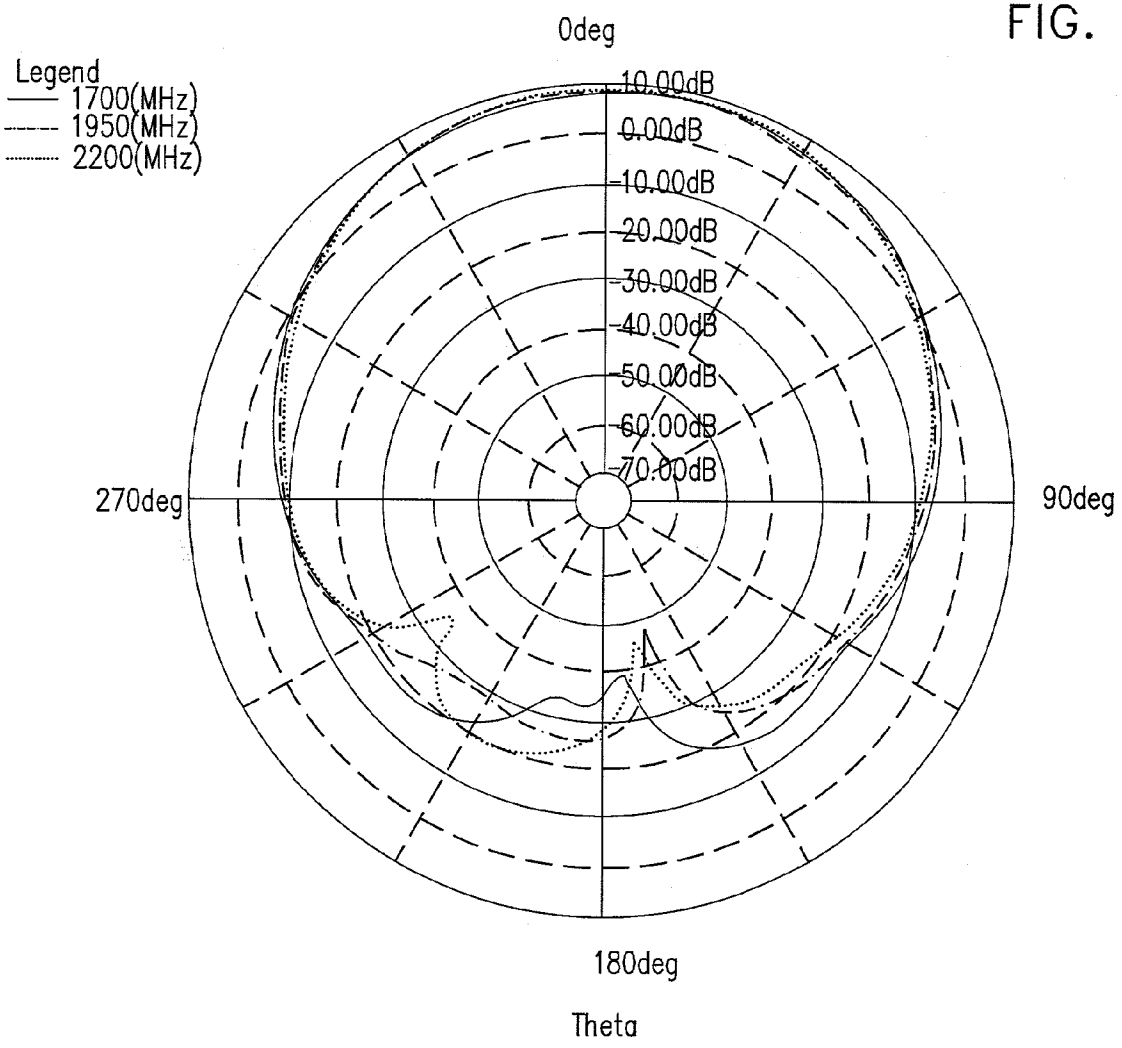
FIGS. 5A, 5B, 5C and 5D are simplified graphs respectively showing E- and H-plane radiation patterns of a radiating element of the type shown in FIG. 3.
Figure 5B:
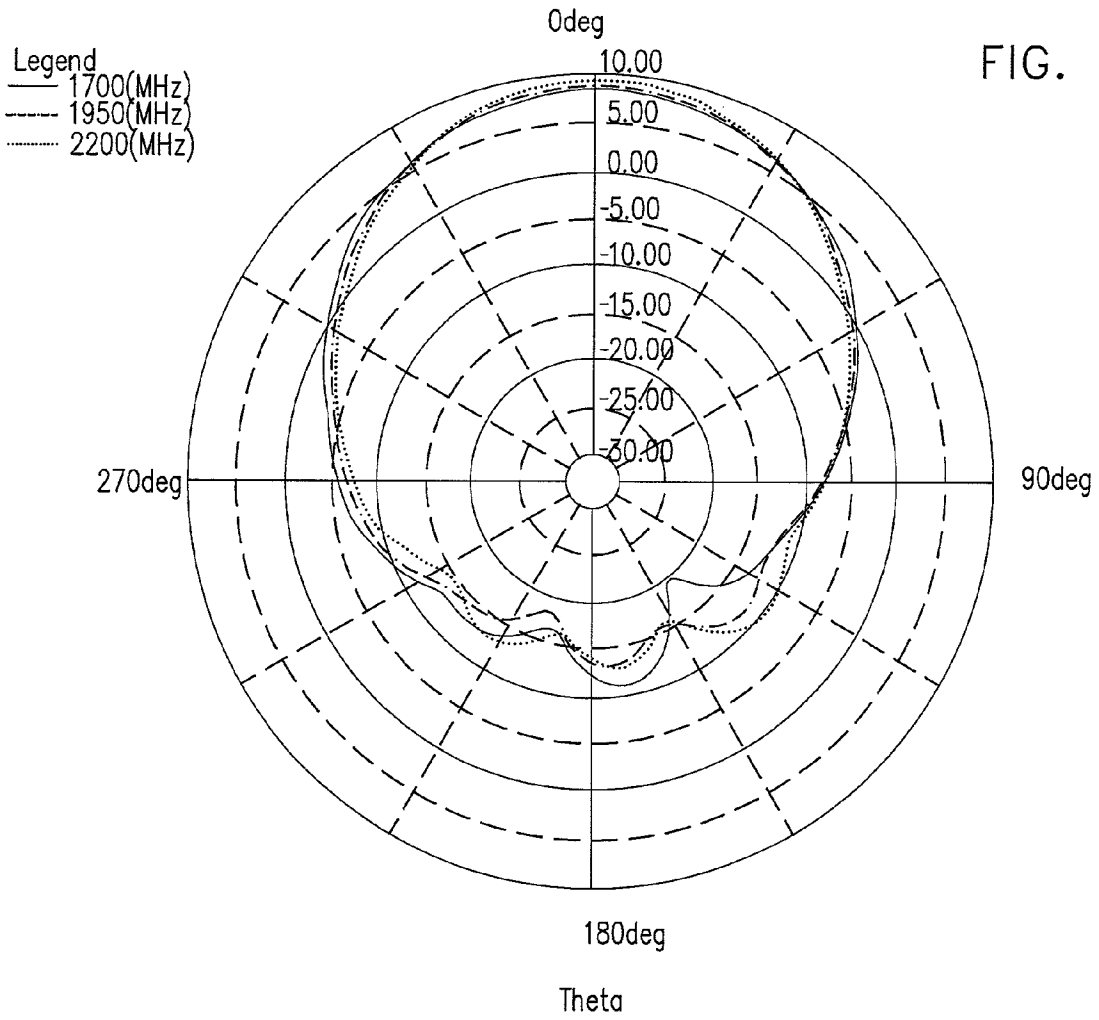
Figure 5C:
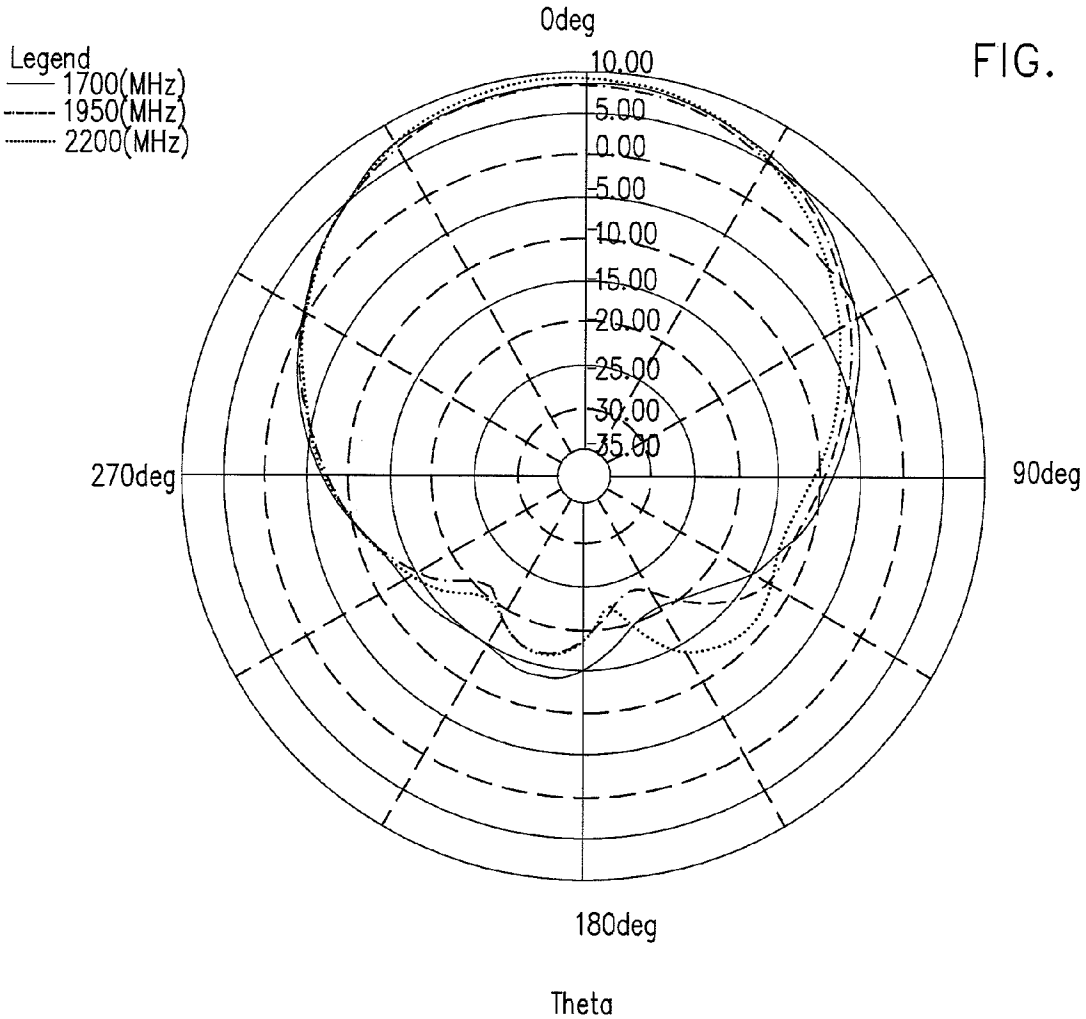
Figure 5D:
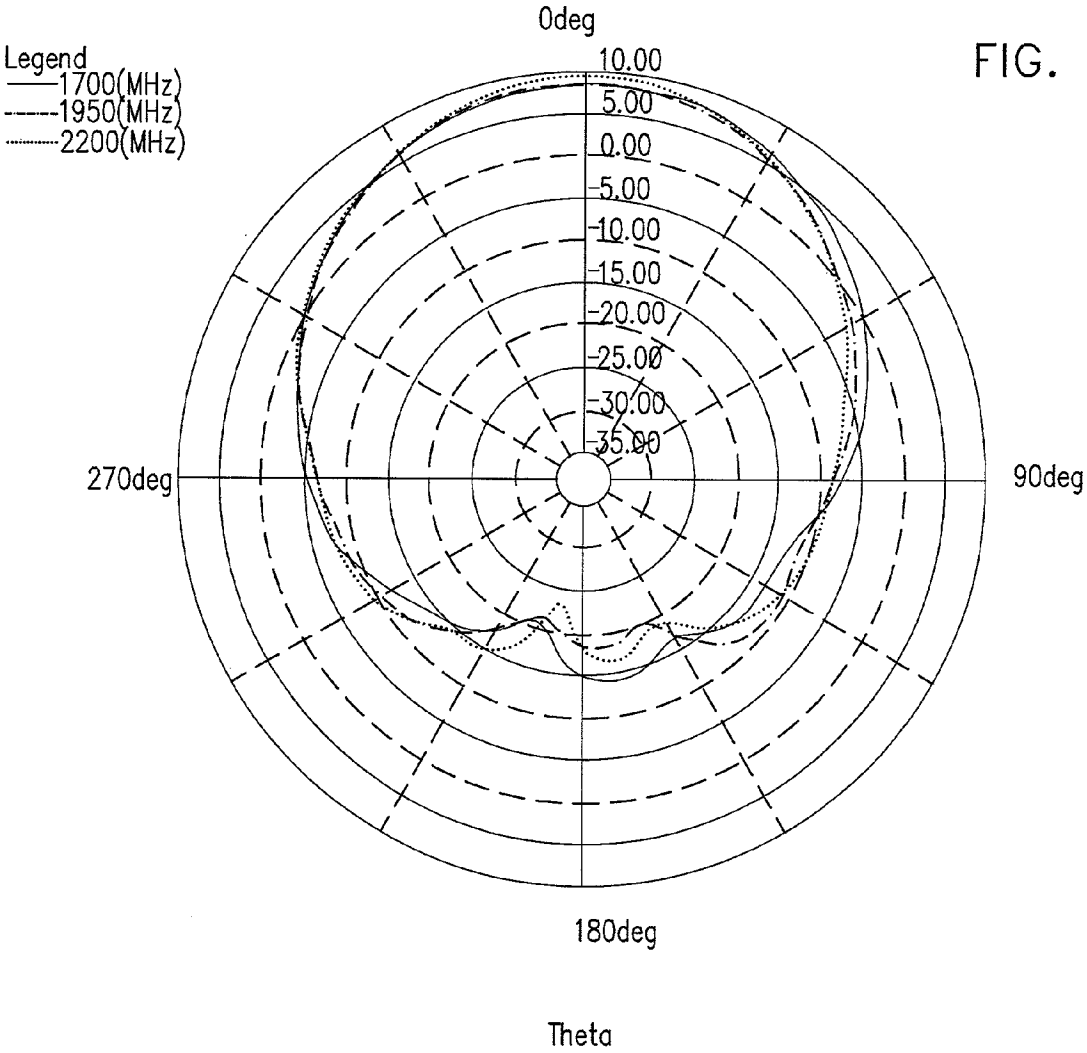

Performance characteristics of broadband dual-polarized dipole radiating element 108 are best appreciated from consideration of FIGS. 5A-5D, in which FIG. 5A shows total gain in the E-plane for ±45° polarization of radiating element 108 at a first port; FIG. 5B shows total gain in the H-plane for ±45° polarization of radiating element 108 at the first port; FIG. 5C shows total gain in the E-plane for −45° polarization of radiating element 108 at a second port and FIG. 5D shows total gain in the H-plane for −45° polarization of radiating element 108 at the second port.

As seen in FIGS. 5A-5D, broadband dual-polarized dipole radiating element 108 is preferably operative as a unidirectional antenna providing balanced coverage over its operating environment, with generally equal E- and H-plane radiation patterns in both of its polarizations. Element 108 furthermore preferably has low back-lobe radiation, thereby minimizing interference between multiple ones of co-located elements 108 operating over similar frequency ranges. Element 108 is therefore suitable for inclusion in an array in which multiple ones of antenna 100 are arranged in close proximity to each other along a single ground plane.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna comprising:

a ground plane;

a dielectric substrate formed on said ground plane;

a +/−45° polarized broadband dual-polarized dipole radiating element located on said dielectric substrate;

a horizontally polarized dipole radiating element located on said dielectric substrate adjacent to said +/−45° polarized broadband dual-polarized dipole radiating element and having a projection parallel to a first axis, which first axis intersects said +/−45° polarized broadband dual-polarized dipole radiating element;

a vertically polarized dipole radiating element located on said dielectric substrate adjacent to said +/−45° polarized broadband dual-polarized dipole radiating element and having a projection parallel to a second axis, which second axis intersects said +/−45° polarized broadband dual-polarized dipole radiating element and is orthogonal to said first axis; and a feed network for feeding said +/−45° polarized broadband dual-polarized, vertically and horizontally polarized dipole radiating elements.

2. An antenna according to claim 1, wherein said broadband dual-polarized dipole radiating element comprises:

a quartet of radiating patches operative as a first pair of dipoles at a first polarization and as a second pair of dipoles at a second polarization, each dipole of said first and second pairs of dipoles comprising two radiating patches of said quartet of radiating patches; and a feed arrangement for feeding said first and second pairs of dipoles, said feed arrangement comprising a feedline galvanically connected to one of said two radiating patches comprising said each dipole and a balun galvanically connected to another one of said two radiating patches comprising said each dipole.

3. An antenna according to claim 1, wherein said horizontally polarized dipole radiating element is located parallel to said first axis and said vertically polarized dipole radiating element is located parallel to said second axis.

4. An antenna according to claim 1, wherein said broadband dual-polarized dipole radiating element is operative to radiate in a high frequency band.

5. An antenna according to claim 4, wherein said horizontally polarized and vertically polarized dipole radiating elements are operative to radiate in a low frequency band.

6. An antenna according to claim 4, wherein said high frequency band comprises frequencies between 1700 and 2700 MHz.

7. An antenna according to claim 5, wherein said low frequency band comprises frequencies between 690 and 960 MHz.

8. An antenna according to claim 1, wherein said dielectric substrate is galvanically connected to said ground plane.

9. An antenna according to claim 8, wherein said dielectric substrate comprises a printed circuit board substrate.

10. An antenna according to claim 9, wherein said feed network is formed on an underside of said printed circuit board substrate.

11. An antenna according to claim 8, wherein said ground plane comprises a tray having a plurality of prolongation strips extending therefrom.

12. An antenna according to claim 1, wherein said feed network receives input signals at a first port and a second port.

13. An antenna according to claim 12, wherein said first and second ports are connected to coaxial cables.

14. An antenna according to claim 12, wherein said feed network comprises at least a first diplexer and a second diplexer.

15. An antenna according to claim 2, wherein said quartet of radiating patches is supported by a dipole stem, said dipole stem having an X-shaped configuration comprising a first, a second, a third and a fourth rib.

16. An antenna according to claim 15, wherein said feed arrangement comprises:

a first microstrip feedline formed on a first side of said first rib and a first balun formed on a second opposite side of said first rib;

a second microstrip feedline formed on a first side of said second rib and a second balun formed on a second opposite side of said second rib;

a third microstrip feedline formed on a first side of said third rib and a third balun formed on a second opposite side of said third rib; and a fourth microstrip feedline formed on a first side of said fourth rib and a fourth balun formed on a second opposite side of said fourth rib.

17. A multiple-input multiple-output antenna, comprising:

a +/−45° polarized broadband dual-polarized dipole radiating element comprising a quartet of radiating patches operative as a first pair of dipoles at a first polarization and as a second pair of dipoles at a second polarization, each dipole of said first and second pairs of dipoles comprising two radiating patches of said quartet of radiating patches;

a horizontally polarized dipole radiating element located adjacent to said +/−45° polarized broadband dual-polarized dipole radiating element and having a projection parallel to a first axis, which first axis intersects said +/−45° polarized broadband dual-polarized dipole radiating element;

a vertically polarized dipole radiating element located adjacent to said +/−45° polarized broadband dual-polarized dipole radiating element and having a projection parallel to a second axis, which second axis intersects said +/−45° polarized broadband dual-polarized dipole radiating element and is orthogonal to said first axis; and a feed arrangement comprising a first port for feeding said first pair of dipoles and said horizontally polarized dipole radiating element and a second feed port for feeding said second pairs of dipoles and said vertically polarized dipole radiating element, said feed arrangement comprising a feedline galvanically connected to one of said two radiating patches comprising said each dipole and a balun galvanically connected to another one of said two radiating patches comprising said each dipole.

18. A multiple-input multiple-output antenna according to claim 17, wherein said first and second pairs of dipoles are operative to radiate in a high frequency band of 1700-2700 MHz.

19. A multiple-input multiple-output antenna according to claim 17, wherein said quartet of radiating patches is supported by a dipole stem, said dipole stem having an X-shaped configuration comprising a first, a second, a third and a fourth rib.

20. A multiple-input multiple-output antenna according to claim 19, wherein said feed arrangement comprises:

a first microstrip feedline formed on a first side of said first rib and a first balun formed on a second opposite side of said first rib;

a second microstrip feedline formed on a first side of said second rib and a second balun formed on a second opposite side of said second rib;

a third microstrip feedline formed on a first side of said third rib and a third balun formed on a second opposite side of said third rib; and a fourth microstrip feedline formed on a first side of said fourth rib and a fourth balun formed on a second opposite side of said fourth rib.

* * * * *